US006786817B2

(12) United States Patent
Orendorff

(10) Patent No.: US 6,786,817 B2
(45) **Date of Patent: *Sep. 7, 2004**

(54) VENT ASSEMBLY

(75) Inventor: Gary R. Orendorff, Beaverton, OR (US)

(73) Assignee: Classic Manufacturing NW, LLC, Wilsonville, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/383,314

(22) Filed: Mar. 7, 2003

(65) Prior Publication Data

US 2003/0220070 A1 Nov. 27, 2003

Related U.S. Application Data

(63) Continuation-in-part of application No. 10/154,949, filed on May 23, 2002.

(51) Int. Cl.[7] ..... F24F 13/12

(52) U.S. Cl. ..... 454/290; 137/625.48; 454/324

(58) Field of Search ..... 454/290, 299, 454/324, 274; 137/625.48, 597; 251/326, 328

(56) References Cited

U.S. PATENT DOCUMENTS

| | | | | |
|---|---|---|---|---|
| 1,788,721 A | | 1/1931 | Klomparens | |
| 2,930,309 A | | 3/1960 | Prager | |
| 3,236,171 A | | 2/1966 | Vaskov et al. | |
| 3,509,812 A | | 5/1970 | James | |
| 3,528,359 A | | 9/1970 | Sand | |
| 3,589,265 A | | 6/1971 | Hedrick | |
| 3,938,430 A | | 2/1976 | Koppang | |
| 3,955,483 A | | 5/1976 | Sunter | |
| 3,955,591 A | * | 5/1976 | Baumann | 137/270 |
| 4,319,520 A | | 3/1982 | Lanting et al. | |
| 4,394,958 A | | 7/1983 | Whitney et al. | |
| 4,417,687 A | | 11/1983 | Grant | |
| 4,907,500 A | | 3/1990 | Brown | |
| 5,052,440 A | * | 10/1991 | Frank et al. | 137/625.33 |
| 5,163,871 A | | 11/1992 | Huibregtse et al. | |
| 5,472,380 A | | 12/1995 | Sarazen, Jr. et al. | |
| 6,066,044 A | | 5/2000 | Orendorff | |
| D432,226 S | | 10/2000 | Orendorff | |
| 6,227,962 B1 | | 5/2001 | Orendorff | |
| 6,422,935 B1 | | 7/2002 | Yampolski | |

FOREIGN PATENT DOCUMENTS

| | | | | |
|---|---|---|---|---|
| FR | 730.634 | | 8/1932 | |
| FR | 2 478 252 | * | 9/1981 | 251/326 |
| GB | 1 349 450 | | 4/1974 | |
| GB | 1 436 555 | * | 5/1976 | 251/326 |
| GB | 2 001 413 | * | 1/1979 | 251/326 |
| IT | 488694 | * | 12/1953 | 251/326 |

OTHER PUBLICATIONS

Specification sheet entitled "Evaporative Diffusers" by Shoemaker, dated prior to filing of application.

* cited by examiner

*Primary Examiner*—Harold Joyce
(74) *Attorney, Agent, or Firm*—Klarquist Sparkman LLP

(57) ABSTRACT

A vent assembly has a vent cover and sliding air flow regulator for controlling the flow of air through the vent cover. Plural sets of unique couplers may be used to interconnect the air flow regulator and vent cover for relative sliding motion. Desirably, two such couplers are provided at each end of the assembly with an associated one of such couplers being adjacent to each of the corners of the assembly in the event a rectangular assembly is provided.

34 Claims, 6 Drawing Sheets

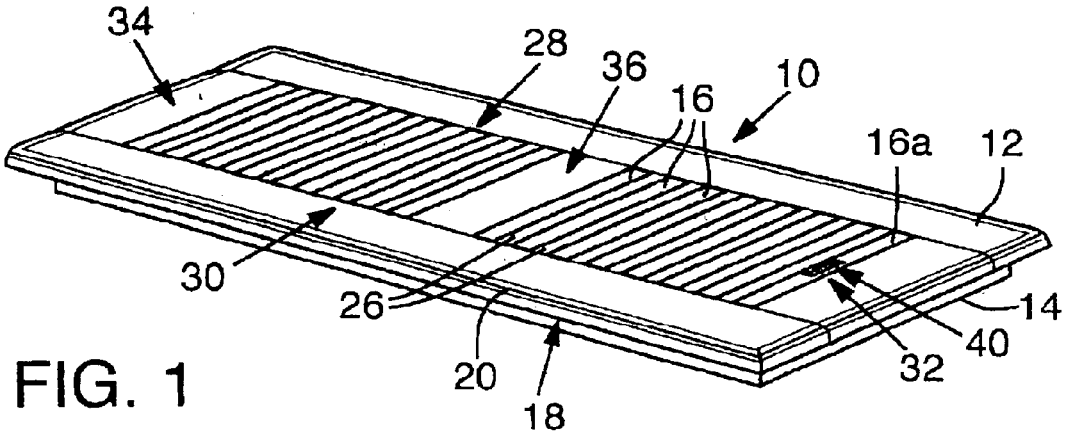
FIG. 1
FIG. 2
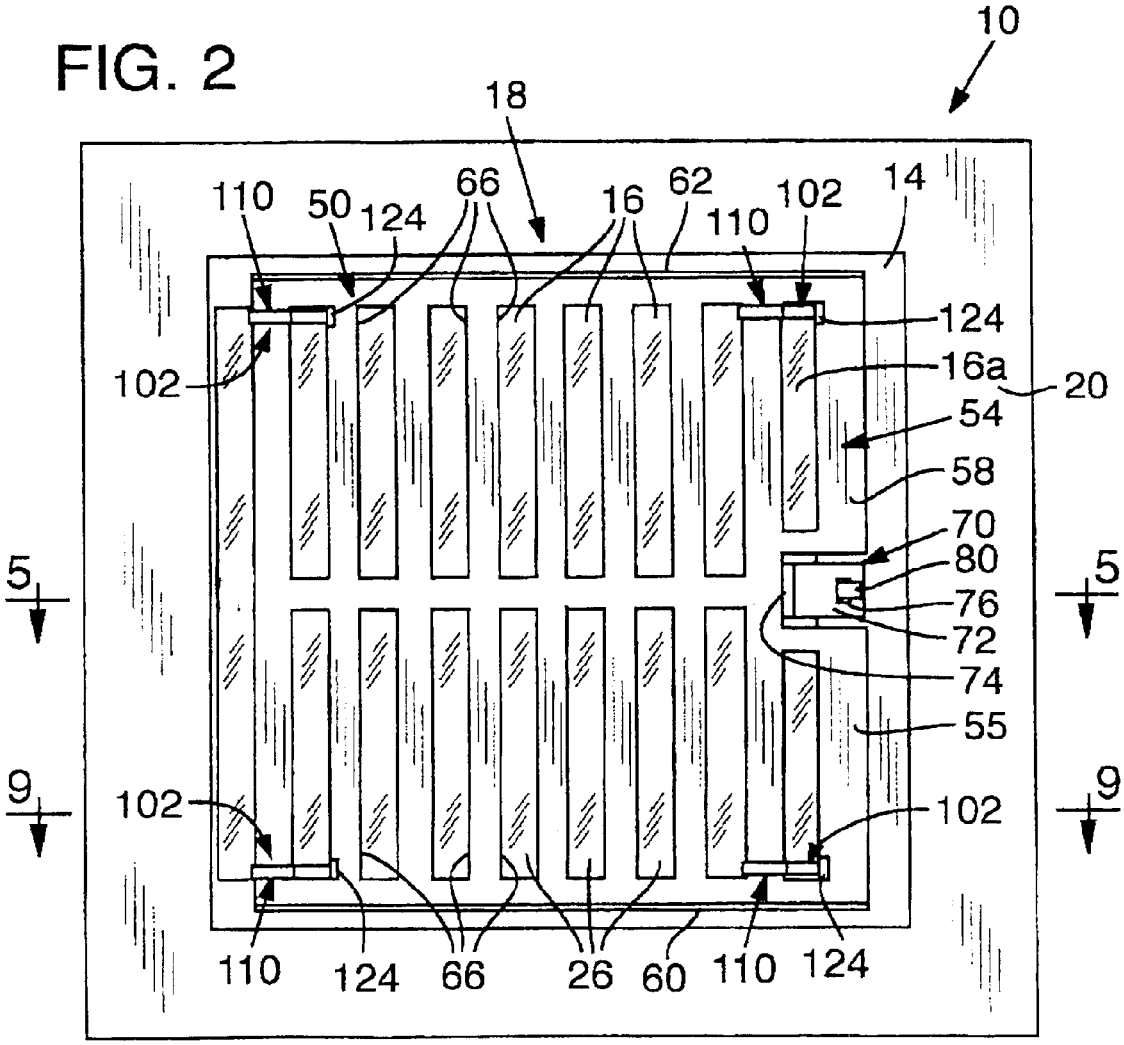

FIG. 5
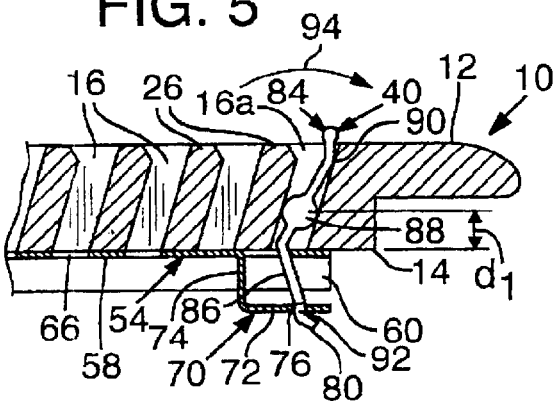
FIG. 6
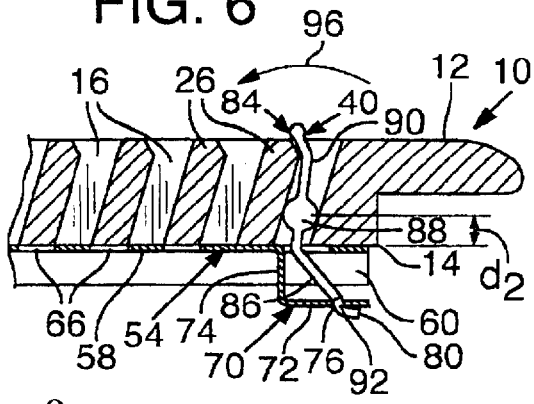
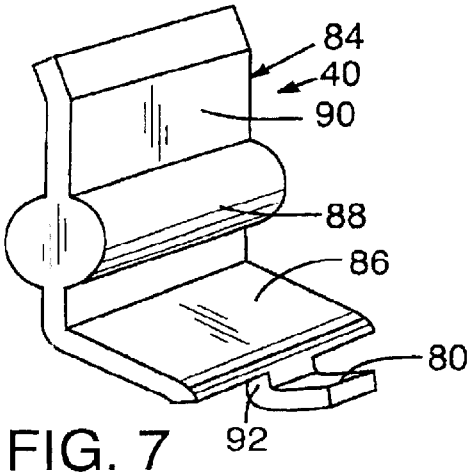
FIG. 7
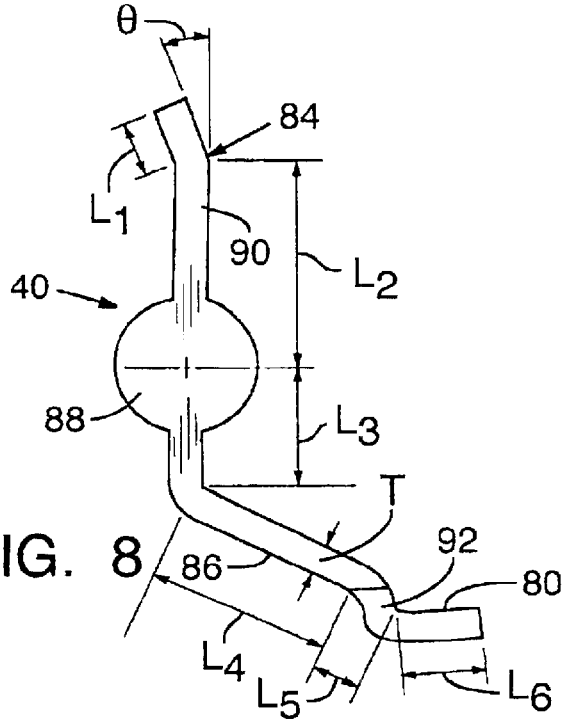
FIG. 8
FIG. 9
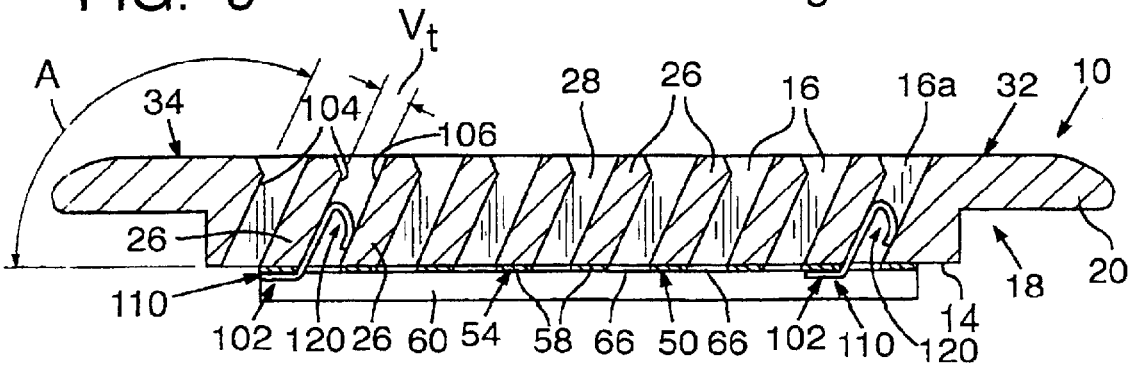

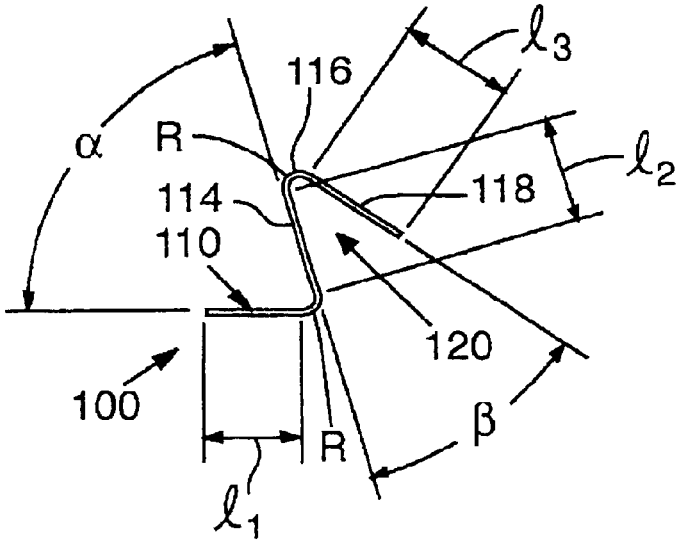
FIG. 10A
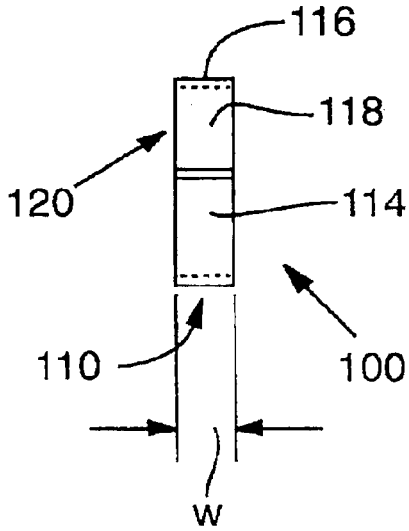
FIG. 11
FIG. 10B
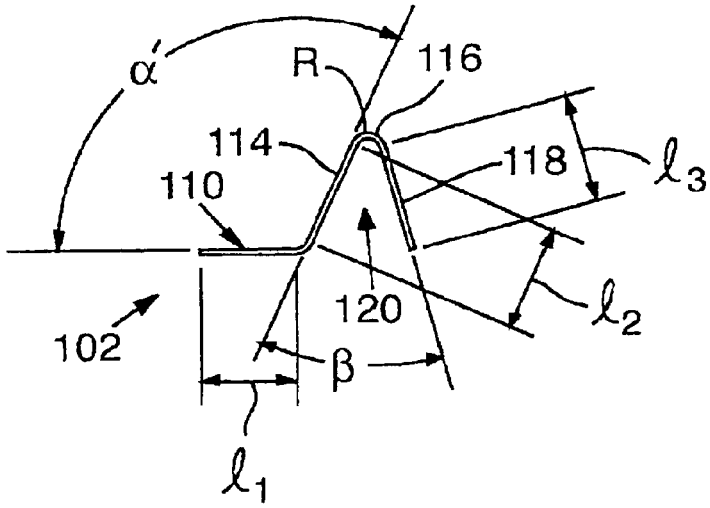

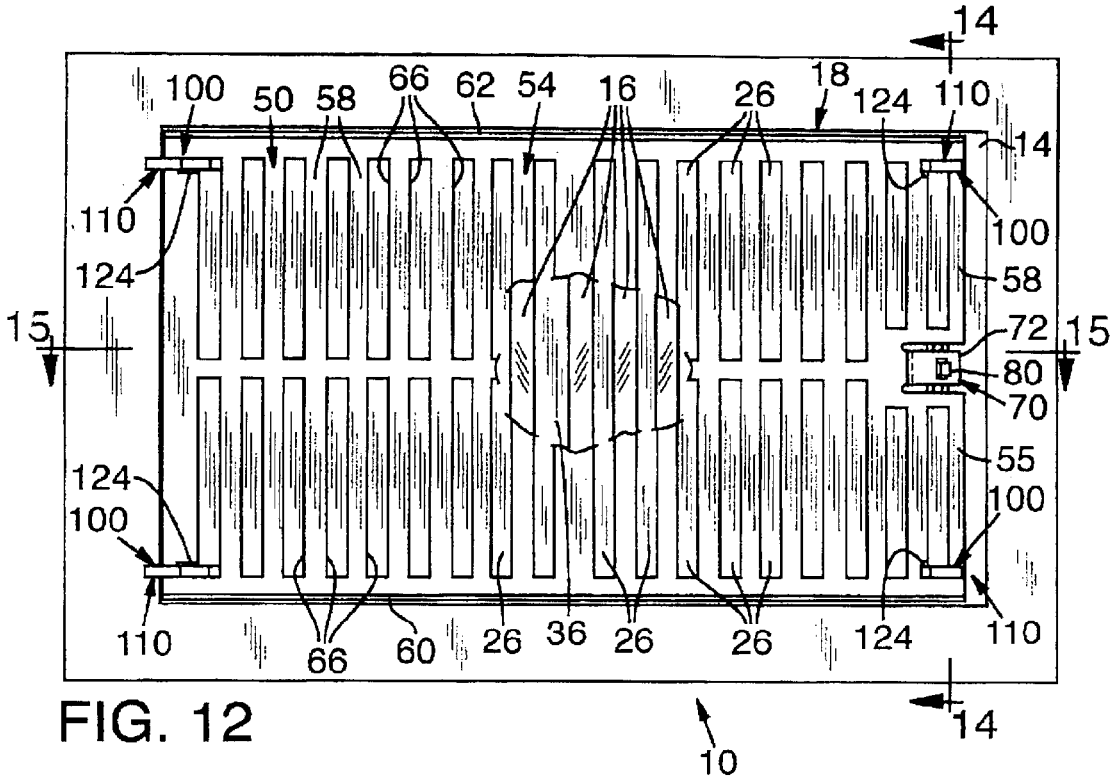
FIG. 12
FIG. 13
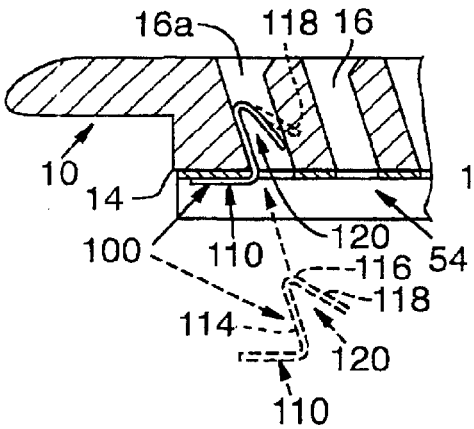
FIG. 14
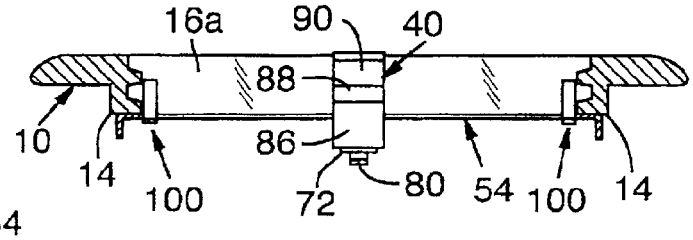

VENT ASSEMBLY

CROSS-REFERENCE TO RELATED APPLICATION

This application is a continuation-in-part of application Ser. No. 10/154,949, filed May 23, 2002, inventor Gary R. Orendorff, and entitled "Vent Assembly and Method", which is incorporated in its entirety herein by reference.

FIELD

The present invention relates to a vent assembly having an air flow regulator slidable relative to a vent cover to control the flow of air through the vent cover and wherein the air flow regulator is detachably coupled to the vent covering and also to related methods.

BACKGROUND

Vent assemblies with a cover and a sliding air flow regulator or grill of various constructions are known. For example, U.S. Pat. No. 5,472,380 to Sarazen, Jr. et al. is understood to illustrate a construction in which a register or vent cover slidably receives a slide grill. The register defines a groove between the underside of vanes of the register and the upper surface of ridges formed in opposed sidewalls of the register. A handle, or tab, which can be integrally formed as part of the slide grill, extends upwardly in the space between two vanes of the cover so that it can be used to slide the grill.

U.S. Pat. No. 2,930,309 to Prager is understood to disclose an adjustable ventilator which has a vaned louver plate on one surface of a wall. A slidable plate assembly is located at the opposite side of the wall. The slidable plate assembly includes a cover having a plurality of openings which overlies a slide plate. Handles extend through slots in the cover and are used to slide the slide plate to selectively block or open the openings through the cover.

U.S. Pat. No. 3,509,812 to James is understood to illustrate a construction of a ventilator having an apertured back member fixed to a supporting surface and a front apertured member which is slidably mounted to the back member.

Although constructions of this type are known, a need exists for an improved vent assembly and method.

SUMMARY

The present invention is directed toward new and unobvious aspects of a vent assembly and method acts alone and in various combinations and subcombinations with one another. The invention is not limited to a vent assembly or method which includes all of the various components described below in connection with the illustrated embodiments.

In accordance with a first embodiment, a vent assembly is described for controlling the flow of air through an opening. The assembly comprises a vent cover with a plurality of air flow openings. An air flow regulator is slidable relative to the vent cover from a first closed position in which the air flow regulator substantially blocks the flow of air through the air flow openings to second open positions in which air flow paths are provided through the air flow regulator and air flow openings. By substantially blocking the flow of air, it is meant that air flow is severely restricted as some air flow leakage or minimal air flow may still take place even though the air flow regulator is in the closed position. One or more open positions may be provided with air flow being less restricted by the air flow regulator as the air flow regulator is moved toward its most open position. In this embodiment, a first set of at least two discrete couplers interconnect the air flow regulator and the vent cover at a first end portion of the vent assembly. In addition, a second set of at least two discrete couplers interconnect the air flow regulator and the vent cover at a second end portion of the vent assembly. These couplers permit sliding of the air flow regulator relative to the vent cover. These couplers may each comprise at least one first coupler portion coupled to the air flow regulator and at least one second coupler portion frictionally coupled to the vent cover. The first coupler portion of each coupler may support the air flow regulator. The at least one second coupler portion may be inserted into a coupler receiving opening in the vent cover, such as into an air flow slot between vanes of the vent cover. The second coupler portion may frictionally engage the boundaries defining the coupler receiving opening, such as the walls of air flow directing vanes, to retain the air flow regulator in a coupled relationship to the vent cover.

As another aspect of an embodiment, the air flow regulator may comprise plural guide openings through which the plural couplers respectively extend. The guide openings guide the sliding motion of the air flow regulator. In desirable forms, the air flow guide openings may comprise elongated slots oriented in a direction parallel to the direction in which the air flow regulator slides.

Couplers which engage the air flow regulator may have a first angular compressible portion which is compressed when inserted into a respective coupler receiver opening. The compressible portion engages the vent cover within the coupler receiving opening to couple the air flow regulator to the vent cover. The compressible member may comprise a band of resilient spring material bent for compression upon insertion into the coupler receiving opening and biased against the walls of the coupler receiving opening.

As another aspect of an embodiment, the vanes may define slots oriented at a first angle relative to the inner major surface of the vent cover. In addition, the second coupler portions may comprise a band section of spring material formed with an acute angle.

In accordance with one specific embodiment, only two of said couplers are provided at each end portion of the vent assembly.

BRIEF DESCRIPTION OF THE DRAWINGS

FIG. 1 is a perspective view of one form of a vent cover assembly in accordance with an embodiment of the present invention.

FIG. 2 is a bottom view of a vent assembly in accordance with a second embodiment.

FIG. 5 illustrates one form of actuator for shifting the air flow regulator between open and closed positions with the actuator shown in an air flow regulator open position in FIG. 5.

FIG. 6 is similar to FIG. 5 with the actuator shown in an air flow regulator closed position in FIG. 6.

FIG. 7 is a perspective view of the actuator embodiment shown in FIGS. 5 and 6.

FIG. 8 is a side elevational view of the actuator of FIG. 7.

FIG. 9 illustrates a vent assembly with one form of couplers for coupling an air flow regulator or slide member to a vent cover.

FIG. 10A is a side elevation view of one of the couplers of FIG. 15.

FIG. 10B is a side elevation view of another of the couplers of FIG. 9.

FIG. 11 is a front view of one of the couplers of FIG. 9.

FIG. 12 is a bottom plan view of the vent cover and air flow regulator assembly of FIG. 1.

FIG. 13 is a schematic sectional view illustrating the installation of a coupler.

FIG. 14 is a transverse sectional view, taken along line 14—14 of FIG. 12.

DESCRIPTION OF ILLUSTRATED EMBODIMENTS

Figure 4A:
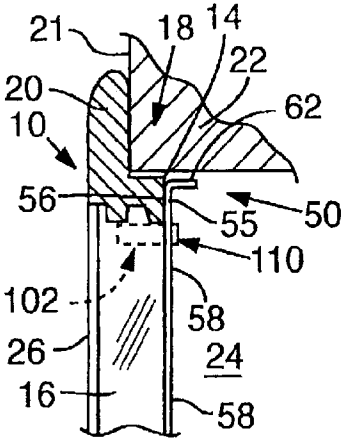
FIG. 4A is a transverse sectional view of a portion of the vent assembly of FIG. 3 taken along line 4A—4A of FIG. 3.

FIG. 1 illustrates one form of vent assembly comprising a vent cover 10, which may be of any suitable durable material such as metal or wood, with wood being a desirable example. The illustrated vent cover has first and second major opposed surfaces 12,14 with a plurality of vent openings, some being indicated at 16, which extend between surfaces 12,14 and through which air may flow. The illustrated vent cover 10 has an inward step around its perimeter, as indicated at 18, with an overhanging projecting rim portion 20 about the perimeter of the vent cover. As can be seen in FIG. 4A, the undersurface of rim 20 may engage the upper surface 21 of a portion of a floor 22 or other support through which a duct opening 24 extends. The step 18 allows the vent cover to be inserted downwardly into the duct opening.

The air flow openings 16 in the illustrated vent cover may be of any configuration and comprise elongated slots which are spaced apart from one another by respective vanes. Two of these vanes are indicated at 26 in FIG. 1. These vanes have wall surfaces which bound and define the respective sides of the air flow slots 16 and are typically angled to assist in directing air as it flows outwardly from the vent assembly. The vanes 26 extend between respective side members or portions 28,30 of the illustrated vent assembly. Side members 28,30 bound and define the respective ends of the air flow slots 16. First and second end members or portions 32,34 extend between the respective side members 28,30 at the respective ends of the vent cover and complete a frame around the perimeter of the vent cover. A central crosspiece 36 is also provided approximately midway between the respective ends of the vent cover 10. The crosspiece 36 also passes between side members 28,30. The air flow slots 16 toward the right side of crosspiece 36 in FIG. 1 may be angled to direct air away from the crosspiece. The slots at the opposite side of the crosspiece are typically angled in the opposite direction. One of these air flow slots, in FIG. 1 the endmost air flow slot indicated at 16*a* to distinguish it from the other slots 16, has a vent assembly actuator indicated generally at 40 positioned, in this example, at least partially therein. Actuator 40 is used to shift the position of an air flow regulator such as a slide member. The air flow regulator is slidably coupled to the vent cover 10 so as to be slid to various positions to control the flow of air from the duct and through the air flow slots 16.

Figure 3:
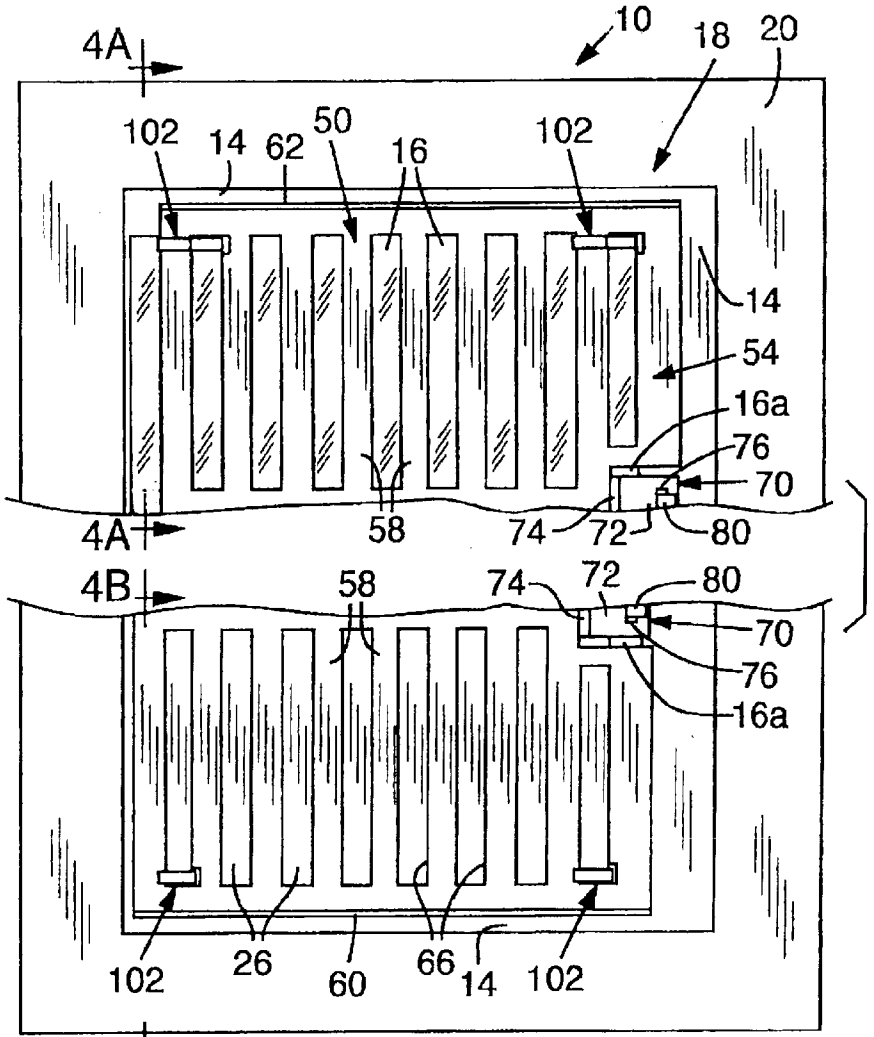
FIG. 3 is a view similar to FIG. 2 with a slide member or air flow regulator shown in a fully opened position in the upper portion of FIG. 3 and in a closed position in the lower portion of FIG. 3.
Figure 4B:
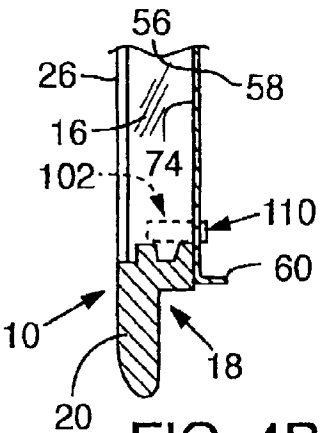
FIG. 4B is a transverse sectional view of a portion of the vent assembly of FIG. 3 taken along line 4B—4B of FIG. 3.

FIG. 2 illustrates the underside of a form of vent assembly having a vent cover 10 like that shown in FIG. 1 except that the vent cover is of a shorter length than that shown in FIG. 1 and lacks the central crosspiece 36. FIG. 2 illustrates one form of an air flow regulator 50 which is slidably coupled to the vent cover 10. In the form shown, the air flow regulator comprises a slide member 54 which may comprise a generally planar plate 55 having opposed first and second major surfaces 56,58 (see FIG. 4A). In the illustrated form in FIG. 2, air flow regulator 50 is rectangular and has four corners. In the embodiment shown, the surface 56 is an upper surface of plate 54 and is positioned adjacent to the surface 14 of the vent cover 10. In addition, the surface 58 is spaced away from the surface 14 and is exposed to view in the embodiment of FIG. 2 when looking at the rear or underside of the vent assembly. The plate 55 has first and second reinforcing side flanges 60,62. The respective flanges 60,62 project outwardly away from the surface 58 and away from the vent cover surface 14. The illustrated slide member 54 has a plurality of spaced apart air flow openings extending between the surfaces 56,58 with some of these openings being indicated at 66 in FIG. 2. Openings 66 may take any convenient configuration. In the illustrated form, these openings comprise elongated rectangular slots extending transversely relative to the longitudinal axis of the plate 55. In FIG. 2, the slide member 54 is shown positioned in a fully open position. In this position, the slots 66 are aligned with corresponding air flow openings 16 of the vent cover. Consequently, minimal resistance is provided to the flow of air upwardly through the slide member and vent cover. In contrast, when slide member is shifted to a fully closed position, the portions of the slide member between the openings 66 are aligned with the air flow openings 16 through the vent cover. This substantially blocks the flow of air through the vent cover. Intermediate open positions are also possible depending upon the extent of the alignment of openings 66 with openings 16. The upper portion of FIG. 3 shows the vent assembly of FIG. 2 with the slide member 54 in the open position. This corresponds to the position shown in FIG. 2. In contrast, the lower portion of FIG. 3 illustrates the vent assembly of FIG. 2 with the slide member 54 shifted to the closed position. FIG. 4A shows a portion of the vent assembly of FIG. 3 in the open position. FIG. 4B shows a portion of the vent assembly of FIG. 3 in the closed position.

FIG. 2 also illustrates one form of an actuator engaging portion 70 of the slide member 54. As can be seen in FIGS. 5 and 6, in connection with one specific form of actuator 40, the actuator engaging member 70 comprises a lower portion 72 spaced below the surface 58 and coupled by a downwardly projecting flange portion 74 to the main body of the slide member 54. Portion 72 of actuator engaging member 70, in the form shown, is provided with an opening or slot 76 for receiving a toe or tab portion 80 of the actuator embodiment shown in FIGS. 5, 6 and 7.

Although not required, for economic efficiency, slide member 54 may be formed out of a single sheet of material by simply cutting and bending the sheet in an appropriate manner. As a specific example, the slide member 54 may be formed of 18 to 20 gauge C.R. low carbon steel. The various embodiments are not limited to the form of slide member shown by member 54 or to the form of actuator engagement mechanism shown at 70. For example, a pin or handle may project upwardly from the air flow regulator where it can be grasped and moved to slide the air flow regulator relative to the vent cover. The pin or handle typically would slide along a slot in the vent cover. Other actuator mechanisms may also be used.

Various forms of couplers may be used to slidably mount the slide member 54 to the vent cover 10. Detachable couplers, particularly those which require no tools for installation, are particularly desirable. In accordance with an illustrated embodiment, a first set of plural couplers, such as at least two spaced apart couplers is positioned adjacent to a first end portion of the vent cover. The couplers of the first set are each inserted into a respective associated coupler guide opening (described below) and into engagement with the vent cover so as to slidably couple the air flow regular to the vent cover. Desirably at least one coupler of the first set is positioned adjacent to a first corner of the air flow regulator at the first end portion of the vent cover. In addition, desirably at least one other coupler of the first set of couplers is positioned at the opposite corner of the air flow regulator and at the first end portion of the vent cover. These couplers slidably couple the air flow regulator to the vent cover. In addition, a second set of plural couplers, such as at least two spaced apart discrete couplers are positioned adjacent to a second end portion of the vent cover and opposite to the first end portion of the vent cover. Each of the couplers of the second set are inserted through an associated coupler guide opening and into engagement with the vent cover. Desirably at least one coupler of the second set of couplers is positioned adjacent to a third corner of the air flow regulator at the second end portion of the vent cover. In addition, desirably a second coupler of the second set of couplers is positioned adjacent to the opposite corner of the air flow regulator at the second end portion of the vent cover. The second set of couplers also slidably couple the air flow regulator to the vent cover. In a desirable form, each coupler comprises at least one first coupler portion coupled to and supporting the air flow regulator so as to permit sliding movement of the air flow regulator or slide member. In addition, each such coupler desirably comprises at least one second coupler portion which frictionally engages the vent cover. As a specific example, second coupler portions which are compressed in at least one direction within coupler receiving openings of the vent cover may be used. As a more specifically desirable example, the coupler receiving openings in the vent cover may comprise one or more of the air flow openings. A particularly desirable form of coupler is a clip. As a specific example, the couplers may be made of a resilient band of material, such as of spring steel, bent into an appropriate shape.

In the embodiment shown in FIG. 2, a first set of two spaced apart couplers, each in the form of a clip 100, are positioned at a first end portion of slide member 54. In addition, a second set of couplers 102, each in the form of a clip, are positioned at the opposite end portion of slide member 54. The couplers 100, 102 in the form shown are discrete clips that are spaced apart from one another. In the embodiment shown in FIG. 2, each coupler is adjacent to a respective one of the corners of the slide member 54. Additional discrete couplers may be included in the first set and also in the second set, if desired.

The operation of the exemplary actuator 40 mentioned above will be best understood with reference to FIGS. 5, 6, 7 and 8. More specifically, with reference to FIG. 7, the actuator 40, in the form shown, comprises a lever 84 having a first portion 86 which is coupled to the air flow regulator. More specifically, in the embodiment shown, the tab 80 projects from the lever first portion 86 for insertion into the opening 76 of actuator receiving portion 72 of the slide member. In addition, the illustrated lever 84 includes a pivot portion 88 which, as can be seen in FIG. 5, in the illustrated embodiment, is positioned at least partially within the slot 16*a* of the vent cover. More specifically, pivot portion 88 in the illustrated embodiment is configured for positioning entirely within the slot between walls of adjoining portions of the vent cover that define slot 16*a*. In addition, lever 84 comprises a grasping portion 90 which projects from the pivot portion and generally away from the air flow regulator or slide member 54 when the vent assembly is assembled.

As can be seen in FIGS. 5, 6 and 7, the first or lower lever portion in the illustrated embodiment is not straight. In particular, the first lever portion 86 is bent, in this case, between the pivot portion and the tab 80. In addition, a shoulder 92 is provided between tab 80 and the lever portion 86. As can be seen in FIGS. 5 and 6, the shoulder 92 bears against the slot 76 as the actuator is operated.

FIG. 5 illustrates the slide member 54 in a fully open position. Lever 84 is pivoted in the direction indicated by arrow 94 to open the vent assembly. In contrast, FIG. 6 illustrates the vent assembly in the closed position. The lever 84 is pivoted in the direction indicated by arrow 96 to close the vent assembly. As can be seen in FIGS. 5 and 6, curved exterior surfaces of the pivot portion 88 engage the walls defining slot 16*a* to guide this pivoting motion. In addition, with the configuration shown, as the actuator is pivoted toward its open position in the direction of arrow 94, the distance $d_1$ between the pivot axis of pivot portion 88 and the undersurface 14 of vent cover 10 increases. That is, the pivot axis is shifted closer to vent cover surface 12. In one specific configuration, the distance $d_1$ is 0.267 inches. In contrast, as the lever 84 of this configuration is shifted toward its closed position in the direction of arrow 96 in FIG. 6, the distance between the pivot axis of pivot portion 88 and surface 14 is decreased. This is indicated by $d_2$ in FIG. 6. With the specific example shown, $d_2$ may be 0.22 inch. Thus, in effect, one form of lever 84 includes a floating pivot which moves toward the upper surface 12 of the vent cover 10 as the actuator is shifted toward its open position. This assists in maintaining the upper portion of lever 84 at a location where it is easier to reach for use in adjusting the position of the slide member 54.

Although the dimensions of the lever form of actuator shown in FIGS. 5, 6, 7 and 8 may vary, specific exemplary dimensions for a construction in which the distance between surface 58 of slide member 54 and the upper surface of engaging member 72 is 0.244 inch are as follows. The lettering and angle designations set forth below correspond to the lettering and angles used in FIG. 8.

| Example 1 | Example 2 |
|---|---|
| $\theta$ = 25 degrees | $\theta$ = 25 degrees |
| $L_1$ = 0.110 inch | $L_1$ = 0.156 inch |
| $L_2$ = 0.401 inch | $L_2$ = 0.375 inch |
| $L_3$ = 0.250 inch | $L_3$ = 0.272 inch |
| $L_4$ = 0.358 inch | $L_4$ = 0.440 inch |
| $L_5$ = 0.104 inch | $L_5$ = 0.077 inch |
| $L_6$ = 0.138 inch | $L_6$ = 0.094 inch |
| T = 0.057 inch | T = 0.062 inch |

In addition, the width of the lever 84 may be 0.609 inch and width of the tab 80 may be 0.157 inch. The actuator lever 84 may be made of any suitable material and may, for example, be extruded of aluminum with the extrusion being separated into actuators of the appropriate width and with the tab 80 being formed by machining.

The clips 100,102 may take a number of forms. Desirable forms of clips 100,102 are illustrated in FIGS. 9, 10A, 10B, and 11. With reference to FIG. 9, the air flow openings 16,16*a* through vent cover 10, as mentioned above, are defined by vanes 26 and respective portions of the end pieces 32,34. More specifically, the air flow openings are defined by respective spaced apart and adjacent walls 104,106 of these components. The walls may be angled relative to horizontal such as indicated in FIG. 9. An exemplary angle is indicated at A in FIG. 9. Although variable, an exemplary desirable angle for a wooden vent is 16 degrees either side of vertical (e.g., 74° or 106° from horizontal). This angle results in improved air flow throw and spread characteristics for a wooden vent cover with all of the vanes at the same angle or vanes at one side of the center of the vent cover at 74° and those at the opposite side of the center of the vent cover at 106°. Although not required, desirably, for this style of vent cover, the vane angle is within plus or minus three or four degrees of 16 degrees either side of vertical. In addition, the walls 104,106 are spaced apart a distance $V_t$ in FIG. 9, corresponding to the width of the air flow slots 16. Although the dimensions of the air flow slots may vary, an exemplary $V_t$ is 0.24 inch.

The clips 100 may be identical to one another or, although less desirable, they may be of a different configuration. In addition, the clips 102 may be identical to one another or, although less desirable, they may also be of a different configuration. In the example of FIG. 9, clips 100 are identical to one another and clips 102 are also identical to one another. Clip 100 will be described in detail in connection with FIGS. 10A and 11. Clip 102 is shown in FIG. 10B. The illustrated clip 100 comprises a first coupler portion which in this example comprises air flow regulator support portion 110. As can be seen in FIG. 9, support portions 110 support the slide member 54 from below. That is, portions 110 of the respective clips 100, 102 are typically positioned adjacent to surface 58 of the slide member 54. In this example, there is no need for the clips 100 or the clips 102 to be interconnected. Also, by making support portion 110 of a band of material having a width and flat upper supporting surface, enhanced stable support of slide plate 54 is provided. In addition, the illustrated clip 100 comprises a coupler portion 120 comprised of at least two coupler sections 114, 118. These coupler sections have a cross-sectional dimension in one direction (the direction corresponding to the distance $V_t$) which is greater than the distance $V_t$. Consequently, when the coupler portion 120 is inserted into a receiving air flow slot 16 or 16*a*, the coupler portion 120 is compressed in at least one dimension for wedging or frictional fit within the receiving opening. As a result, the slide member 54 is held in place without requiring tools to interconnect the slide member to the vent cover in this example. The illustrated coupler portion 120 is comprised of an upwardly extending leg portion 114, a curved end portion 116, and a downwardly extending leg portion 118. By making portions 114, 118 to have an extended width, e.g. width w, greater bearing of the coupler 120 against the walls of the air flow slot is achieved.

Referring back to FIG. 2, at the location where clip portion 110 extends upwardly or transitions to the portion 114, an associated guide opening is provided through the slide member 54. These guide openings may comprise respective slots having longitudinal axes extending in a direction which is parallel to the direction of travel of the slide member 54 relative to the vent cover 10. These slots are desirably of a width which is slightly wider than the width of the illustrated clips. Exemplary slots are indicated at 124 in FIG. 2.

Desirably, the angle α (FIG. 10A) between support portion 110 and leg portion 114 is less than the angle A (FIG. 9). Consequently, as can be understood from FIG. 9, when the clip is installed (e.g., clip 100), an upwardly directed biasing force is exerted by the spring clip against the slide member 54. For example, in FIG. 10, the angle α may range from 60 to 80 degrees with 70 degrees being a specifically desirable example for the illustrated vent cover. Thus, the angle α in FIG. 10A is desirably an acute angle. In FIG. 10B, the corresponding angle α' is an obtuse angle. The angle α' may range from 91 to 111 degrees with 101 degrees being a specifically desirable example for the illustrated vent cover. The angle β between leg portions 114, 118 is also, in the FIG. 10 form, desirably an acute angle and is selected such that adequate biasing forces are provided against the walls of a slot into which coupler section 120 is inserted. As a specific example, β may range from 30 to 50 degrees, with 40 degrees being a specifically desirable example. The clip 100 in this form holds the slide member securely in place against the undersurface 14 of the vent cover while still allowing the desired sliding movement. These clips 100,102 are of a simplified construction and in the desirable form shown, can be formed from a band of material by making only two bends in the material. Although less desirable, the clips may be of wire or other materials which are formed in an appropriate shape. In this illustrated example of clip 100, the distal end of leg portion 118 hangs up on the wall of the vane and hold the slide member in place. Although less desirable, additional bends can be included in the clip.

Although variable, in one specific illustrative example, the dimensions of a specific clips 100, 102 are as follows:

α=70 degrees for clip 100

α'=101 degrees for clip 102

β=40 degrees

R=0.04 inch radius of curvature $l_1$=0.31 inch $l_2$=0.38 inch $l_3$=0.38 inch w=0.13 inch The length $l_1$, is desirably slightly greater than the distance $V_t$ between the walls of the air flow slot. The width w may vary and in a desirable form is at least five to ten times the thickness of the material used to form the clip. A resilient band of material, such as a rectangular strip of 0.016 inch thick S.S.TY.301 full hard stainless steel may be used for the clip.

FIGS. 12–16 illustrate an alternative embodiment of vent assembly. In these figures, corresponding components, even if they differ somewhat in configuration, have been given the same numbers as in the previously described embodiments. The slots 124 may be of a different configuration from those shown in this construction. For example, the slots 124 at the end of the slide member 54 adjacent to actuator engaging portion 70 may be open at one end.

Figure 15:
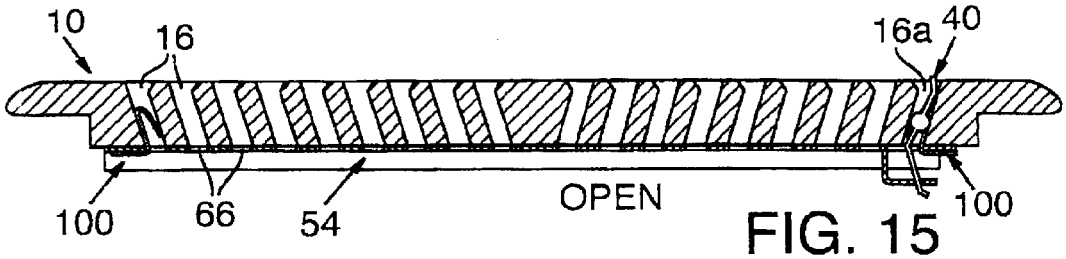
FIG. 15 is a longitudinal sectional view of the vent assembly of FIG. 12, taken along line 15—15 of FIG. 12 and with the vent assembly open.
Figure 16:
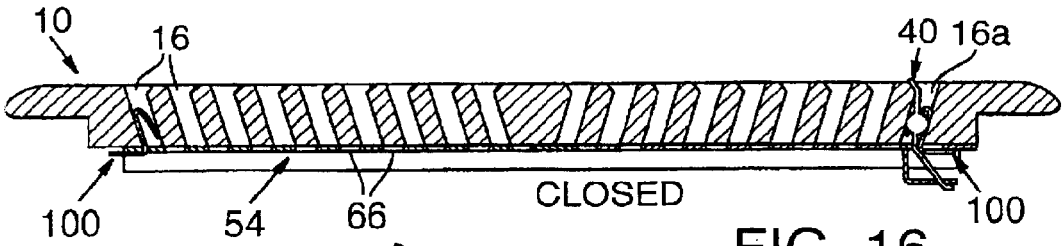
FIG. 16 is like FIG. 15 except with the vent assembly closed.

FIG. 13 schematically illustrates the installation of a clip to couple the slide member 54 to the vent cover. A dashed lined member 118 schematically shows the position of leg section 118 if it were not bent by the wall of slot 16 as it is inserted to the solid line position indicated in FIG. 13. FIG. 15 shows the slide member 54 in an open position while FIG. 16 shows the slide member in a closed position.

Figure 17:
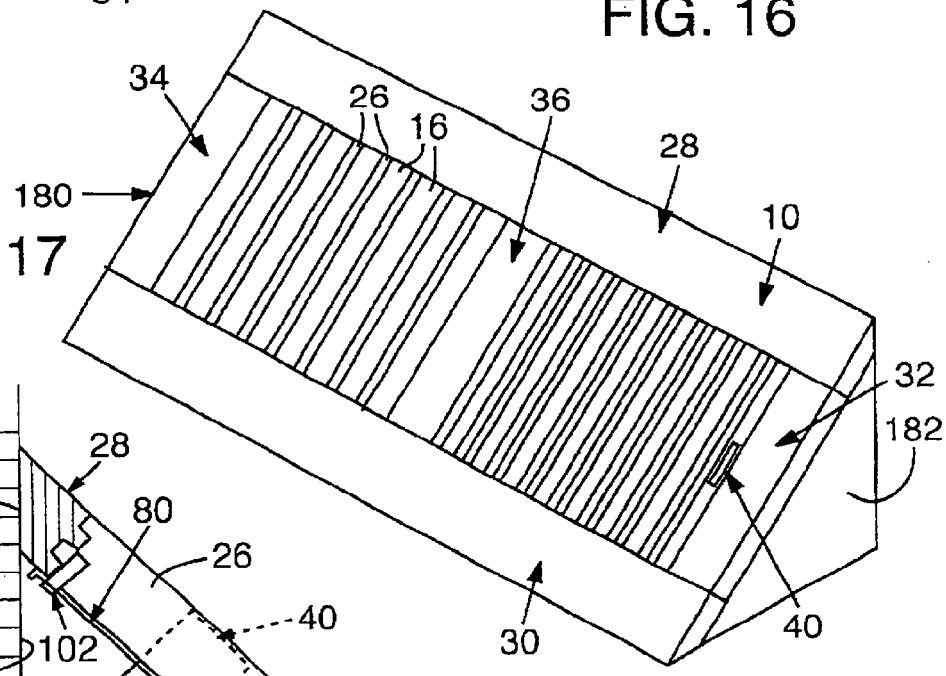
FIG. 17 illustrates a vent assembly usable at a corner location between a floor and wall of a building.
Figure 18:
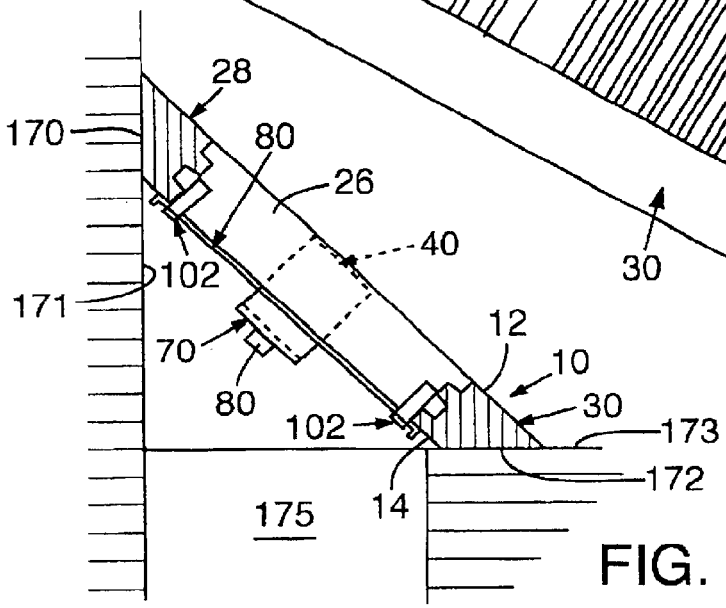
FIG. 18 is a sectional view of the vent assembly of FIG. 17, usable in a corner application.

FIGS. 17 and 18 illustrate one form of an embodiment of a vent assembly which is suitable for a corner application. Given the low profile coupling and actuator configurations which may be used in accordance with embodiments described above, relatively little clearance is required to accommodate the vent assembly in such a corner application. By low profile, it is meant selecting components which project rearwardly from the vent cover a reduced amount. In one specific example, the side portions 28,30 of the vent cover 10 are beveled at 170,172 a desired amount for the particular application in question. For example, these edges may be beveled at 45 degree angles. As a result, edge 172 conforms to the configuration of a floor or other support 173 while edge 170 corresponds to the shape of a wall or other structure 171. A duct 175 is shown in communication with the space beneath the vent assembly of FIG. 18. The ends of the vent assembly in this embodiment may be closed by respective end members 180, 182 which may be triangular in shape. When installed, the lower edges of these end members may rest on the floor surface 173 while the upright edges of these end pieces may bear against the wall 171.

A building may have a plurality of vent assemblies of the various embodiments illustrated and described above.

Although described in connection with several illustrative embodiments, it should be noted that the present invention is not limited to the specific configurations disclosed to illustrate the invention. The present invention is directed toward novel and unobvious aspects and method acts alone and in various combinations and subcombinations with one another. I claim as my invention all such variations as fall within the scope and spirit of the following claims:

I claim:

1. A vent assembly for controlling the flow of air through an opening, comprising:

a vent cover comprising a plurality of air flow openings;

an air flow regulator slidable relative to the vent cover from a first closed position in which the air flow regulator substantially blocks the flow of air through the air flow openings to second open positions in which air flow paths are provided through the air flow regulator and the air flow openings;

the air flow regulator defining a plurality of spaced apart coupler guide openings; and a first set of at least two spaced apart discrete couplers positioned adjacent to a first end portion of the vent cover and each being inserted through an associated one of the coupler guide openings and into engagement with the vent cover so as to slidably couple the air flow regulator to the vent cover, a second set of at least two spaced apart discrete couplers positioned adjacent to a second end portion of the vent cover and each being inserted though an associated one of the coupler guide openings and into engagement with the vent cover so as to slidably couple the air flow regulator to the vent cover, each of said couplers comprising a body having a first support portion positioned to support the air flow regulator and a second vent cover engagement portion inserted through the associated coupler guide opening and into an associated coupler receiving opening defined by the vent cover, the vent cover engagement portion frictionally engaging the vent cover within the associated coupler receiving opening.

2. A vent assembly according to claim 1 wherein at least one of the couplers is of a band of material.

3. A vent assembly according to claim 2 wherein the band of material is rectangular.

4. A vent assembly according to claim 1 wherein each of the couplers is of a band of material.

5. A vent assembly according to claim 4 wherein each band of material is rectangular.

6. A vent assembly according to claim 2 wherein the second vent cover engagement portion of each coupler is compressed during insertion into the associated air flow opening.

7. A vent assembly according to claim 1 wherein the coupler receiving openings each comprise a portion of an air flow opening.

8. A vent assembly according to claim 2 wherein the band of material is formed with only two angles.

9. A vent assembly according to claim 4 wherein each band of material has only two angles.

10. A vent assembly according to claim 2 wherein the second vent cover engagement portion of each coupler has first and second leg portions with a first acute angle existing between the first and second leg portions.

11. The vent assembly according to claim 10 wherein the first acute angle is from thirty to fifty degrees.

12. A vent assembly according to claim 10 wherein the first acute angle is forty degrees.

13. A vent assembly according to claim 10 wherein a second angle exists between the first support portion and the first leg portion.

14. A vent assembly according to claim 13 wherein the second angle is an acute angle between sixty degrees and eighty degrees.

15. A vent assembly according to claim 14 wherein second angle is seventy degrees.

16. A vent assembly according to claim 13 wherein the second angle is an obtuse angle between ninety-one and one hundred and eleven degrees.

17. A vent assembly according to claim 14 wherein second angle is one hundred and one degrees.

18. A vent assembly according to claim 10 wherein a second acute angle exists between the first support portion and the first leg portion.

19. A vent assembly according to claim 10 wherein a second obtuse angle exists between the first support portion and the first leg portion.

20. A vent assembly for controlling the flow of air through an opening, the vent assembly comprising:

a vent cover comprising a plurality of air flow openings;

an air flow regulator of a rectangular shape with four corners, the air flow regulator being slidable relative to the vent cover from a first closed position in which the air flow regulator substantially blocks the flow of air through the air flow openings to second open positions in which air flow paths are provided through the air flow regulator and the air flow openings;

at least four spaced apart discrete couplers, with a respective coupler being positioned adjacent to each of the corners of the air flow regulator, the couplers slidably coupling the air flow regulator to the vent cover, each of said couplers comprising at least one first coupler portion coupled to the air flow regulator and at least one second coupler portion frictionally coupled to the vent cover;

wherein the vent cover comprises plural coupler receiving openings each for receiving a respective second coupler portion, each second coupler portion comprising a compressible member sized so as to be compressed in at least one direction when inserted into a respective one of the coupler receiver openings, the compressible member engaging the vent cover within the coupler receiver opening to couple the air flow regulator to the vent cover.

21. A vent assembly according to claim 20 in which the compressible member comprises a band of spring steel.

22. A vent assembly according to claim 20 wherein there are only four of such couplers.

23. A vent cover according to claim 20 wherein first coupler portion comprises a rectangular air regulator support portion.

24. A vent cover according to claim 20 wherein each coupler comprises a compressible member and a first coupler portion of a respective single one-piece band of material.

25. A vent assembly according to claim 20 wherein the vent cover is supported at an acute angle relative to horizontal when the vent assembly is installed.

26. A building comprising plural vent assemblies of claim 25.

27. A building comprising plural vent assemblies of claim 20.

28. A vent cover assembly comprising:

vent cover means for positioning in a vent opening;

air regulator means for controlling the flow of air through the vent opening; and plural discrete coupler means each formed of a band of material for slidably and frictionally coupling the air regulator means to the vent cover means, the coupler means being spaced apart so as to not contact one another.

29. A vent assembly for controlling the flow of air through an opening, the vent assembly comprising:

a vent cover comprising a plurality of air flow openings;

an air flow regulator of a rectangular shape with four corners, the air flow regulator being slidable relative to the vent cover from a first closed position in which the air flow regulator substantially blocks the flow of air through the air flow openings to second open positions in which air flow paths are provided through the air flow regulator and the air flow openings;

at least four spaced apart discrete couplers, with a respective coupler being positioned adjacent to each of the corners of the air flow regulator, the couplers slidably coupling the air flow regulator to the vent cover, each of said couplers comprising at least one first coupler portion coupled to the air flow regulator and at least one second coupler portion frictionally coupled to the vent cover;

wherein the vent cover comprises plural coupler receiving openings each for receiving a respective second coupler portion, each second coupler portion comprising a compressible member sized so as to be compressed in at least one direction when inserted into a respective one of the coupler receiver openings, the compressible member engaging the vent cover within the coupler receiver opening to couple the air flow regulator to the vent cover;

wherein both the compressible member and the first coupler portions are formed of a single band of material; and wherein each coupler has only two angles formed in the band of material, a first of the angles being formed at a transition from the first coupler portion to the second coupler portion and the other or second of the angles being an acute angle formed in the second coupler portion.

30. A method of coupling an air flow regulator to a vent cover comprising:

positioning the air flow regulator against the underside of the vent cover; and inserting a first set of at least two discrete air flow regulator supporting couplers partially through the air flow regulator and into frictional engagement with the vent cover, inserting a second set of at least two discrete air flow regulator supporting couplers partially through the air flow regulator and into frictional engagement with the vent cover, the first and second sets of couplers being at respective opposite first and second end portions of the air flow regulator from one another.

31. A method according to claim 30 wherein the air flow regulator is rectangular with four corners, and wherein the act of inserting comprises inserting a first coupler in the form of a first clip of the first set of couplers adjacent to a first corner of the first end portion air flow regulator and a second coupler in the form of a second clip of the first set of couplers adjacent to a second corner of the first end portion of the air flow regulator, the second corner at the first end portion of the air flow regulator being spaced from the first corner of the first end portion of the air flow regulator, wherein the act of inserting also comprises inserting a first coupler in the form of a first clip of the second set of couplers adjacent to a first corner of the second end portion of the air flow regulator and a second coupler in the form of a second clip of the second set of couplers adjacent to a second corner of the second end portion of the air flow regulator, the second corner at the second end portion of the air flow regulator being spaced from the first corner at the second end portion of the air flow regulator.

32. A method according to claim 31 wherein there are no other clips coupling the air flow regulator to the vent cover except the first and second sets of couplers.

33. A method according to claim 31 wherein the act of inserting first and second sets of clips comprises inserting clips which are each of a band of material.

34. A method according to claim 31 wherein the frictional engagement is accomplished by compressing a compressible end portion of each coupler with the compressed end portion engaging the vent cover.

* * * * *